US006132350A

United States Patent [19]

Krueger et al.

[11] Patent Number: 6,132,350

[45] **Date of Patent: *Oct. 17, 2000**

[54] METHOD AND APPARATUS FOR AUTOMATICALLY LINING A CONTAINER

[75] Inventors: Friedrich Krueger, San Jose; Robert Johnson, Santa Clara, both of Calif.

[73] Assignee: K&R Equipment, Inc., San Jose, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/004,179

[22] Filed: Jan. 7, 1998

Related U.S. Application Data

[63] Continuation of application No. 09/004,179, Jan. 7, 1998, abandoned, which is a continuation-in-part of application No. 08/742,513, Nov. 1, 1996, Pat. No. 5,735,786.

[51] Int. Cl.[7] ..... B31B 7/00

[52] U.S. Cl. ..... 493/101; 53/175; 53/386.1

[58] Field of Search ..... 493/95, 99, 100, 493/101; 53/386.1, 175, 492

[56] References Cited

U.S. PATENT DOCUMENTS

| | | | |
|---|---|---|---|
| 3,523,492 | 8/1970 | Bruce | 93/36.01 |
| 3,592,004 | 7/1971 | Lense | 53/358 |
| 3,653,111 | 4/1972 | Bruce | 493/100 |
| 3,672,122 | 6/1972 | Berger et al. | 53/384 |
| 3,774,509 | 11/1973 | Heinzer | 53/175 |
| 4,009,646 | 3/1977 | Mott | 93/36.01 |
| 4,015,515 | 4/1977 | Johnson | 93/8 |
| 4,052,931 | 10/1977 | Morse et al. | 493/101 |
| 4,083,293 | 4/1978 | Goldstein | 493/100 |
| 4,089,255 | 5/1978 | Akoh et al. | 53/175 |
| 4,142,453 | 3/1979 | Gidewall et al. | 493/100 |
| 4,430,068 | 2/1984 | vom Hofe et al. | 493/101 |
| 4,505,694 | 3/1985 | Okushita | 493/101 |
| 4,522,012 | 6/1985 | Nelson | 53/175 |
| 4,537,584 | 8/1985 | Everman et al. | 493/101 |
| 4,687,462 | 8/1987 | Rewitzer | 493/100 |
| 4,698,951 | 10/1987 | Everman et al. | 53/175 |
| 4,723,935 | 2/1988 | Furukawa | 493/100 |
| 4,729,209 | 3/1988 | Owensby et al. | 493/100 |
| 4,735,031 | 4/1988 | Langen | 493/101 |
| 4,795,413 | 1/1989 | Johnson et al. | 493/101 |
| 4,874,354 | 10/1989 | Johnson et al. | 493/101 |
| 5,059,084 | 10/1991 | Krein | 414/467 |
| 5,199,246 | 4/1993 | Rodrigo | 53/175 |
| 5,279,537 | 1/1994 | Lile | 493/100 |

FOREIGN PATENT DOCUMENTS 100829 10/1961 Netherlands .

*Primary Examiner*—Eugene L. Kim
*Attorney, Agent, or Firm*—Medlen & Carroll, LLP

[57] ABSTRACT

The present invention provides for a method and apparatus for automatically lining a container having at least one open end. A bag-type liner having a leading sealed, and a trailing unsealed, end is fed along a predetermined liner path, with the trailing unsealed end suspended above the container. A plurality of clamps grab the sides of the bag at the unsealed end and separate the unsealed end by pulling the sides apart. A vacuum is then activated to draw air out of the container through the bottom of the container, drawing the wall of the liner material against the interior surface of the container, thereby fully opening the liner in the container. If the container has two oppositely facing open ends, a vent can be positioned under one of the open ends for drawing air out from the container. If the container has only one open end, a plurality of vacuum tubes can be inserted into the bottom of the container along the interior surface of the container for drawing air out of the bottom of the container.

19 Claims, 14 Drawing Sheets

METHOD AND APPARATUS FOR AUTOMATICALLY LINING A CONTAINER

REFERENCE TO RELATED APPLICATION

This application is a continuation of copending U.S. patent application Ser. No. 09/004,179 filed on Jan. 7, 1998 (now abandoned), which is a continuation-in-part of copending U.S. patent application Ser. No. 08/742,513 filed Nov. 1, 1996 which issued on Apr. 7, 1998 as U.S. Pat. No. 5,735,786.

FIELD OF THE INVENTION

The present invention relates to methods and equipment for lining containers. In particular, the present invention provides a method and apparatus for automatically opening and inserting a bag-type liner into a container.

BACKGROUND OF THE INVENTION

A thin plastic liner or the like is often employed in a shipping box or other container to increase the shelf-life of foods or other perishable commodities or to prevent leakage or spillage of product from a sealed shipping container. Such plastic liners are often in bag form.

A common method of lining containers has been to manually place the liner over the open end of the container and then drawing the liner into the container using a vacuum as shown in U.S. Pat. No. 4,052,931 to Morse et al., or by blowing the liner into the container as shown in U.S. Pat. No. 4,537,584 to Everman et al. Attempts have also been made to automatically open the liner before placing the liner over the open end of the container by using a vacuum assembly as shown in U.S. Pat. No. 4,522,012 to Nelson, U.S. Pat. No. 4,083,293 to Goldstein, and U.S. Pat. No. 4,537,584 to Everman et al. However, the use of such vacuum assemblies in a totally automated lining process has been problematic. Vacuum cup or vacuum bar assemblies in totally automatic assemblies do not provide a positive grasp on each side of the liner to enable the sides of the liner to be completely pulled apart. In addition, simply separating the sides of the bag at the open end does not completely open the bag since the sides of the bag tend to cling together due to surface tension or other adhesion between the inner surfaces of the liner. If the liner is not completely opened before it is placed over the container, the liner can tear. Attempts to break such surface tension or adhesion while using vacuum cups or bars to separate the sides of the liner have been unsuccessful.

Another method is disclosed in U.S. Pat. No. 5,059,084 to Krein. There, two methods are discussed for installing a liner in a semi-tractor trailer. In the first method, an unopened liner is manually unrolled into the trailer with the open end facing the entrance of the trailer (no discussion is provided on how the liner will be unrolled or by what mechanism). A blower is secured to the open end and the liner inflated. When the liner is fully expanded, the open end can be sealed against the entrance using, for example, tension bars 28 and 30. In an alternative embodiment shown in FIG. 8 (see col. 5 line 8), the liner is unrolled and the open end is sealed against the entrance. A vacuum is drawn through a pair of vertical vacuum members 24 inserted at the rear of the trailer near the door hinges. These members evacuate the air in the trailer, drawing the liner up against the trailer wall. Krein suggests that other kinds of vacuum arrangements can be used, such as horizontal members extending from the door of the trailer back into the rear of the container. However, Krein does not disclose whether such members would be permanently installed in the trailer, or simply inserted during the procedure. If the latter, Krein does not suggest where the members would be located or how they would be inserted and withdrawn.

Yet another method is described in U.S. Pat. No. 4,874,354 to Johnson et al. There, a liner is positioned above a container with the liner opening facing toward the container. A jaw assembly grasps the liner and fits the unsealed end of the liner around the opening of the container; subsequently, the liner is inverted into the container using a vacuum created in the container using a plenum over which the container has been positioned. Once in the container, the liner expands in the inverted configuration to line the inside of the container. A drawback with this invention is that there must be sufficient room above the container to accommodate the jaw assembly and an extended liner while the liner is being cuffed to the container. This is apparent from FIG. 1 of the '354 patent wherein the liner is in an extended configuration as it is being cuffed to the container. If the liner is not extended, the vacuum plenum will not be able to efficiently draw the bag into the container. Furthermore, this invention will only work if the container is substantially open at the bottom for providing access of the plenum to the inside of the container. Still further, with this device, the liner is inverted in the container. This can cause a configuration problem if a specific side of the liner must contact the inner surface of the container. For example, if one side of the liner is more or less water permeable.

What is therefore needed is a quick and reliable method and apparatus for lining a container having one or two openings. Furthermore, the apparatus must also be compact so as to minimize its space requirements. Still further, the apparatus must allow for lining of a container without inverting the liner during the lining process.

SUMMARY

The present invention contemplates an apparatus for lining containers having one or more walls and at least a first open end, comprising: means for feeding a flexible bag-type liner having walls, a sealed end and an unsealed end, a clamping means for grabbing the unsealed end of the liner and separating the walls at the unsealed end of the liner; and a vacuum means for drawing air out of the container for fully opening the liner in the container.

In one embodiment, the present invention contemplates a method for lining containers with a flexible bag-type liner comprising the steps of: providing a flexible bag-type liner having a sealed end and an unsealed end, a container having at least a first open end, a plurality of clamps, and a means for drawing air from said container; suspending the liner in the container with the sealed end inside the container and the unsealed end outside the container; grabbing the unsealed end of the liner with the clamps; pulling the clamps apart to open the unsealed end of the liner; and actuating the means for drawing air from the container to open the liner in the container, and cuffing the unsealed end of the liner over the open end of the container.

In a preferred embodiment, the present invention contemplates a method for lining containers with a flexible bag-type liner comprising the steps of: providing a continuous source of flexible liner having a generally tubular shape, a leading sealed end; a cutting and sealing means; a container having at least a first open end; a plurality of clamps; and a means for drawing air from said container. In one embodiment, the sealed end of the liner is dropped through the first open end and into the container; engaging the liner with the cutting and shaping means a predetermined distance from the sealed end, thereby cutting off a section of the liner to form an unsealed end, and creating a new sealed edge on the continuous flexible liner; grabbing the unsealed end of the liner with the plurality of clamps; pulling the clamps apart to open the unsealed end of the bag; and actuating the means for drawing air to draw air out of the container from between the bag and the container, thereby fully opening the bag into the container.

In another, more preferred embodiment, the sealed end of the liner is dropped along the outside surface of the container, the unsealed end is grabbed with a plurality of clamps, and at least some of the clamps are moved away from the other clamps to open the unsealed end of the bag and to draw at least one side of the bag over the open end of the container before actuating the means for drawing air to suck the liner into the open end of the container, thereby fully opening the bag into the container.

In either of these embodiments, the method further comprises the step of cuffing the unsealed end of the liner over the open end of the container.

Likewise, in either of these embodiments, the means for drawing air comprises a vacuum plenum over which the container is positioned during lining. Alternatively, the means for drawing air from the container comprises a plurality of tubes communicating with a vacuum generator, said tubes inserted into the container through the open end, before the actuating step.

DETAILED DESCRIPTION OF THE PREFERRED EMBODIMENT

The following description serves to illustrate a preferred embodiment and aspects of the present invention and is not to be construed as limiting the scope thereof.

In considering the method and apparatus of the present invention some definitions are helpful. For example, "cuffing" refers to the process of forming a cuff of the flexible liner along the outside open edge of the container. A "means for drawing air" or vacuum means refers to any means for drawing air from a container. This means does not necessarily create a perfect vacuum but instead may include a means for creating a near vacuum condition. "Grabbing" refers to the clamps of the present invention engaging the sides of the plastic liner. An illustration of a suitable clamp and typical grabbing action can be seen in U.S. Pat. No. 4,874,354 to Johnson et al., which is hereby incorporated by reference.

"Inverting the liner/bag" refers to turning the liner/bag inside-out. "Vacuum tubes" refer to tubes that are coupled to a device for drawing air (i.e. a vacuum cleaner, a reversible blower, a fan blade). The tubes can have any cross sectional shape.

Figure 1:
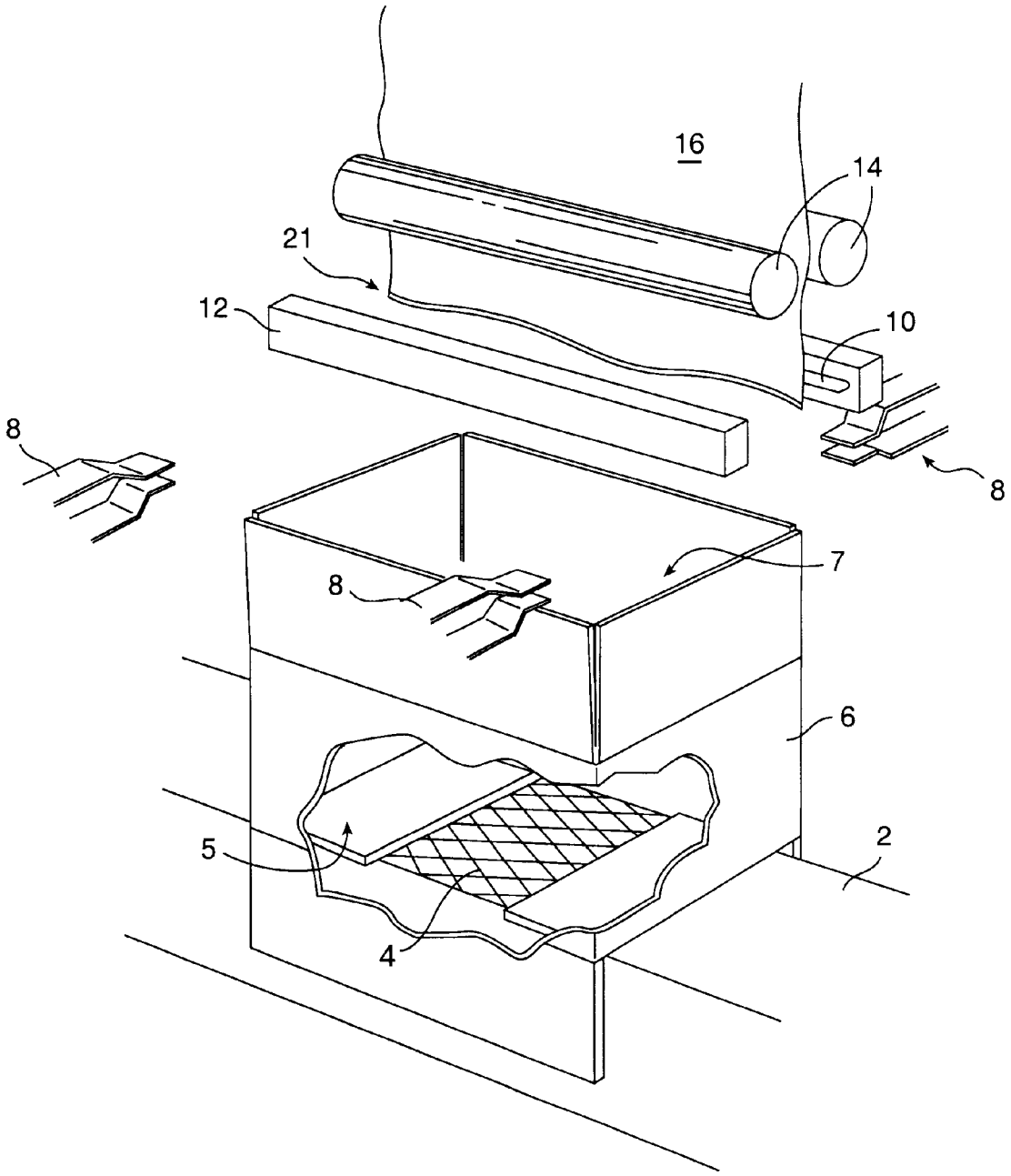
FIG. 1 provides a perspective view of a preferred embodiment of the present invention.

FIG. 1 illustrates a perspective drawing of a preferred embodiment of the present invention. Specifically, the device comprises a conveyor 2 for supporting a container 6 such as a typical cardboard box. As with many cardboard boxes, the container 6 has a set of four flaps on the top and bottom for sealing the box. The container is placed on the conveyor 2 with at least two of the bottom flaps open so that the inside of the container is exposed to the vent 4. The vent 4 is coupled to any conventional means for drawing air from the inside of the container (i.e. for creating a vacuum or near vacuum condition). For example, a fan can be incorporated to draw air from the inside of the container 6.

Positioned above the container 6 are two rollers 14 for feeding a flexible liner 16 (i.e. a plastic or latex liner), having a sealed end 21. Although illustrated here as employing two rollers, it should be apparent to one skilled in the art that any means for feeding a flexible liner can be used and this invention is not limited to a particular number of rollers or to rollers at all.

A clamp cylinder 12 and a knife 10 are preferably located directly beneath the rollers 14 for cutting off a section of the liner and sealing the bottom edge of the next liner 24. The clamp cylinder 12 and knife 10 are designed in such a manner that a sealing means is located above a cutting means. This allows the clamp cylinder 12 and knife 10 combination remove a section of the liner wherein the liner section has an unsealed top 22, while the remaining liner is sealed at its bottom. By sealing the bottom of the remaining liner, the present invention ensures that upon the next cycle, the next liner section will have a sealed bottom edge 24. Any conventional and well known sealing means can be used such as those used to seal plastic food bags (i.e. a heated metal or composite strip). The cutting edge can be any edge sharp enough to cut through the liner. Alternatively, a roll of pre-sealed liners with perforations for separating one liner from the next can be used with the present invention.

Below the clamp cylinder 12 and knife 10 are clamps 8 for engaging the liner section and spreading open the unsealed end 22 of the liner section. Although the clamps 8 can be of any design for gripping the sides of a liner and separating them, an example of a suitable design is illustrated in U.S. Pat. No. 4,874,354 to Johnson et al., hereby incorporated by reference. Furthermore, it is contemplated in the preferred embodiment that four clamps 8 be incorporated roughly located above the four corners of the container 6. This does not preclude, however, the application of more or less clamps or different positions of the clamps 8.

Figure 2A:
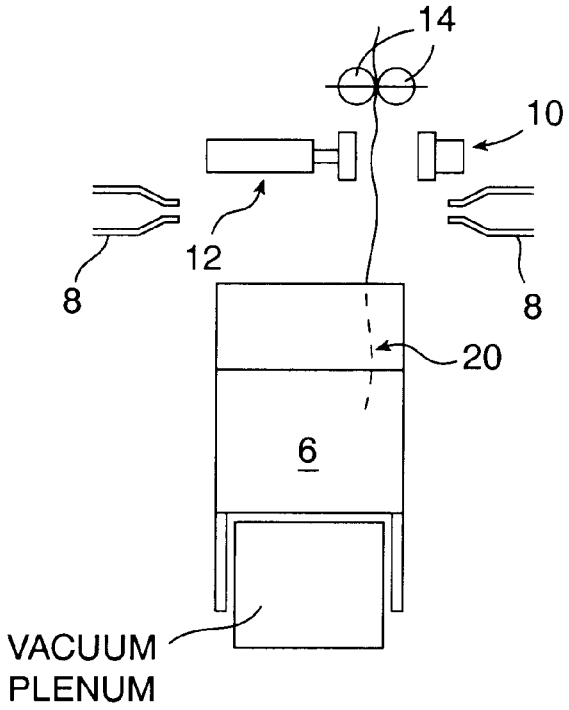
FIGS. 2A through 2G illustrate the sequence of steps performed by the preferred embodiment of FIG. 1 when lining a container.
Figure 2B:
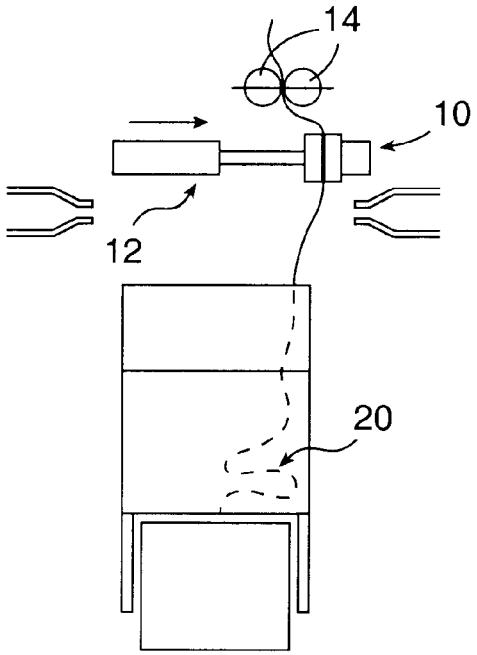
Figure 2C:
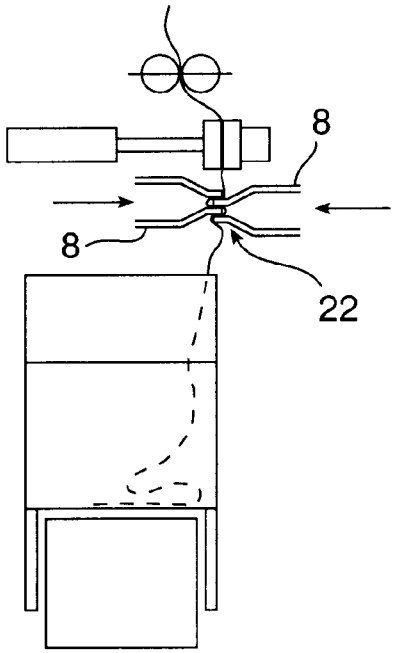

FIGS. 2*a–g* illustrate this preferred embodiment in operation. In FIG. 2*a*, the conveyer 2 positions a new container 6 below clamps 8 while the two rollers 14 feed a length of liner 16 (sealed end 21 first) into the container 6 through open end 7. When the appropriate length has been fed, the clamp cylinder 12 and knife 10 engage the liner 16 thereby cutting a section of the liner 16 and sealing the bottom edge 24 of the next liner in FIG. 2B. While the clamp cylinder 12 and knife 10 are still engaged, the clamps 8 grip the liner section below the clamp cylinder 12 and knife 10 in FIG. 2C. It should be noted that while shown here in this order, the present invention should work equally well if the clamps 8 grip the liner before the clamp cylinder 12 and knife 10 engage. It should also be noted that while a minimum of two clamps 8 are necessary for proper operation, additional clamps may also be incorporated.

Figure 2D:
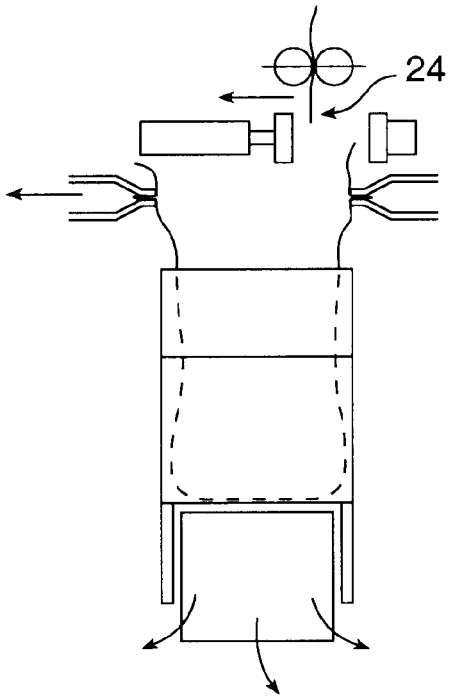
Figure 2E:
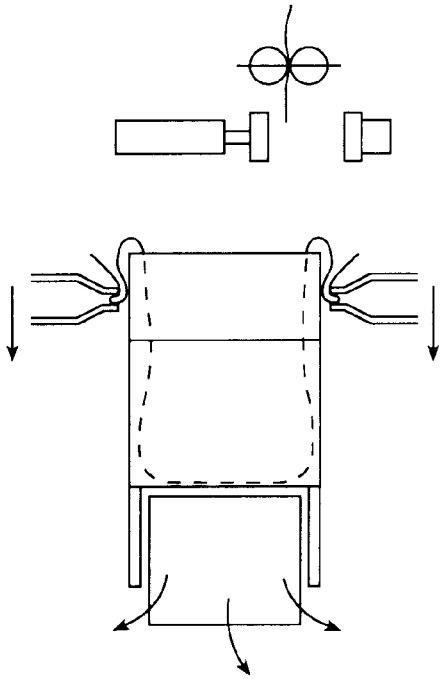
Figure 2F:
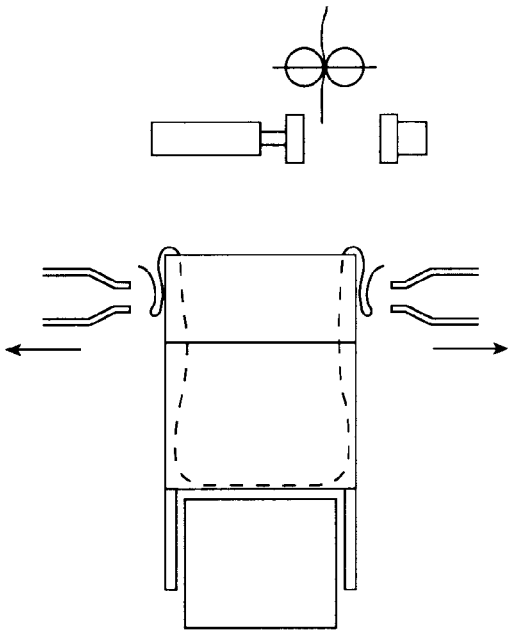
Figure 2G:
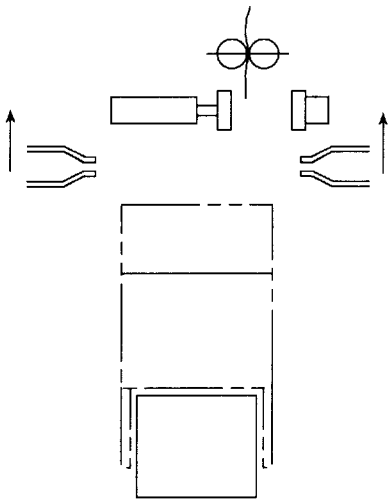

In FIG. 2D, the clamps 8 open the liner section by spreading apart the sides of the liner section. A vacuum or near vacuum condition is then created in the container by removing air from the container through open end 5 via the vent 4. This draws the walls of the liner against the inside of the container. The clamps 8 then cuff the liner section over the top of the container by pulling the ends of the liner section down around the outside of the open end 7 of the container 6 in FIG. 2E. Once the liner section has been cuffed, the clamps 8 open and clear the container 6 in FIG. 2F and the vacuum is stopped. Finally, the clamps 8 return to their original position as a new container is moved into position as shown in FIG. 2*g*. It should be noted that while this embodiment describes the vacuum as preferably expanding the liner section in FIG. 2*d*, such expansion could also occur at step 2*e* or 2*f* and possibly at step 2*g*.

Figure 3:
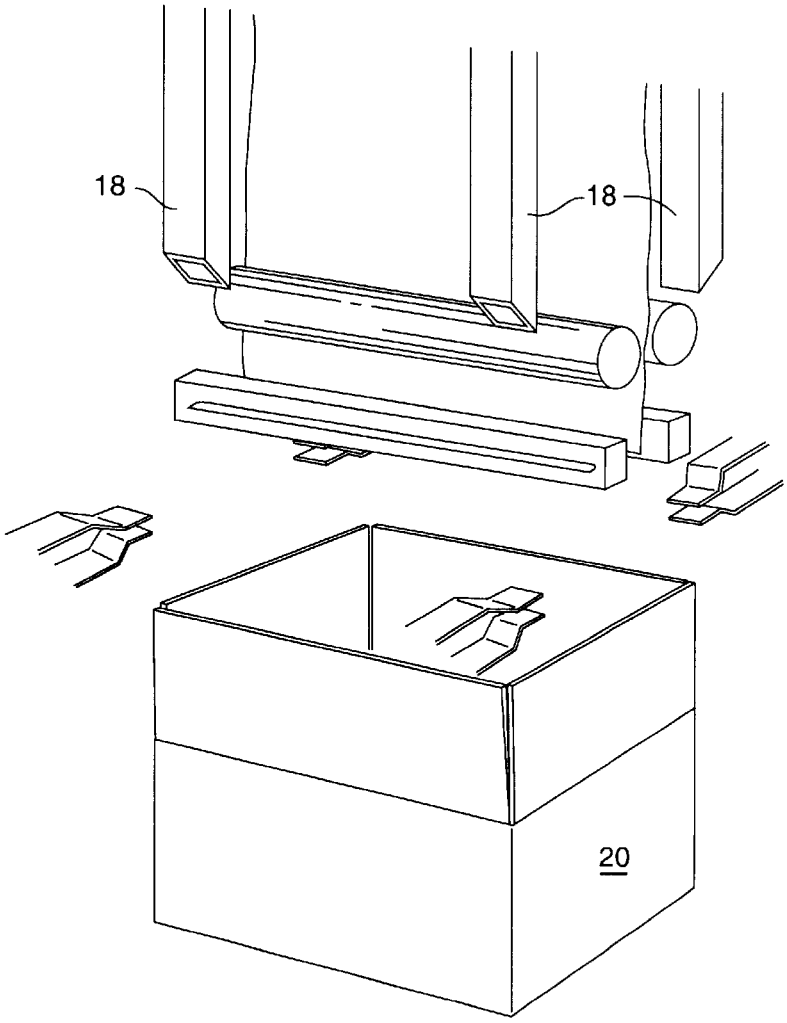
FIG. 3 provides a perspective view of an alternative preferred embodiment of the present invention.

An alternate preferred embodiment is illustrated in FIGS. 3 and 4. FIG. 3 is a perspective diagram of the alternate preferred embodiment which is similar to FIG. 1 and having similar elements. Specifically, elements 8, 10, 12, 14, 16, 21, 22 and 24 are the same as the similarly numbered elements from FIGS. 1 and 2. Two significant distinctions between this embodiment and the previous embodiment are that this embodiment incorporates vacuum tubes 18 and it can be utilized on a container 20 having a closed bottom.

The vacuum tubes 18 are any tubes which are sufficiently able to draw air from a container. For example, the tubes may be coupled to a fan or vacuum plenum having sufficient suction power to expand the liner section in the container. Furthermore, although the vacuum tubes 18 are illustrated as having a square cross section, they can have any cross sectional shape such as a circle, hexagon, oval, etc. The container 20 can be, although is not limited to, a cardboard box similar to container 6 illustrated in FIGS. 1 and 2, except that the bottom flaps are closed and/or sealed. Furthermore, the container 20 can be placed on a conveyor belt for automatic positioning of a new containers at the start of each cycle.

Figure 4A:
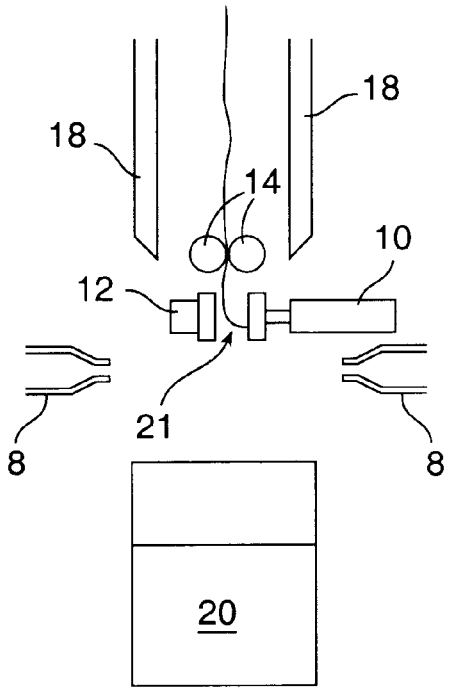
FIGS. 4A through 4H illustrate the sequence of steps performed by the alternative embodiment shown in FIG. 3 when lining a container.
Figure 4B:
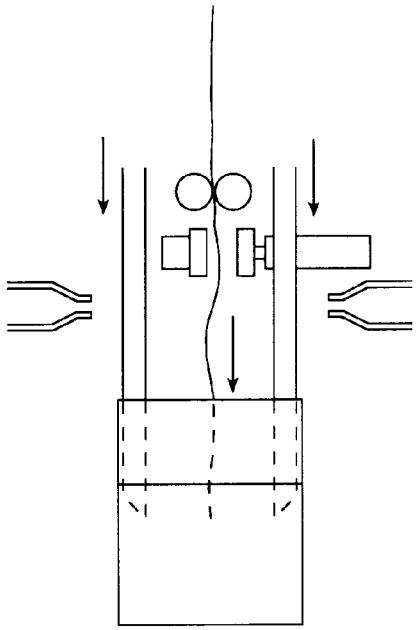

FIGS. 4*a–h* illustrate one cycle of the alternate preferred embodiment in operation. FIG. 4*a* illustrates the position of the different elements of this embodiment at the start of a cycle when a new container 6 is positioned. At FIG. 4B, rollers 14 feed a length of the liner 16 into the container while the vacuum tubes 18 are lowered into the container 20 at its four corners. It should be noted that while described here as being inserted at the container's four corners, it is also contemplated that the vacuum tubes 18 be inserted at points other than the four corners or at only one, two or three corners. Furthermore, it is also contemplated that fewer than four vacuum tubes could be utilized.

Figure 4C:
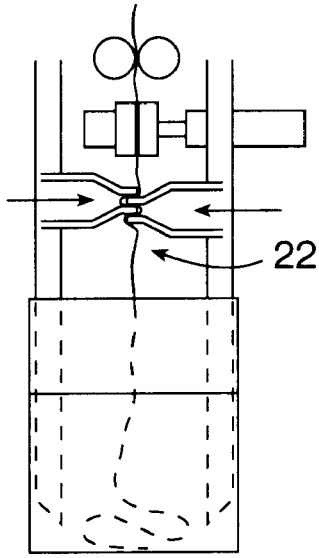
Figure 4D:
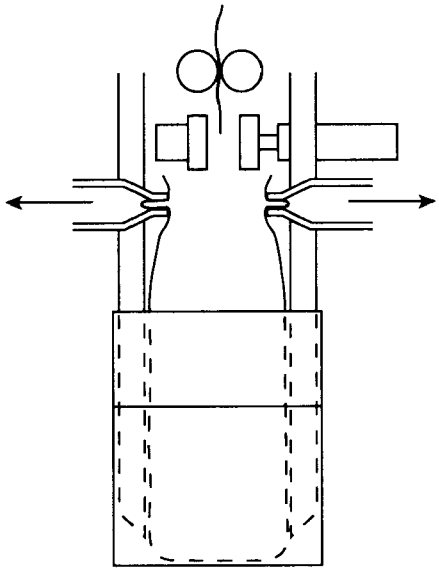

In FIG. 4C, a clamp cylinder 12 and knife 10 are preferably provided to engage the liner 16 and cut a section of the liner 16 while simultaneously sealing the bottom end 24 of the next liner. However, as noted above, it would be possible to use pre-sealed liners perforated for easy separation. The clamps 8 also grab the unsealed end of the liner section during this step. In FIG. 4D, the clamp cylinder 12 and knife 10 disengage and the clamps 8 and draw open the sides of the liner section. Meanwhile, the vacuum tubes 18 are activated to draw air from the space between the sides of the liner section and the sides of the container 20, thus forming a vacuum. This vacuum causes the walls of the liner section to be drawn against the walls of the container.

Figure 4E:
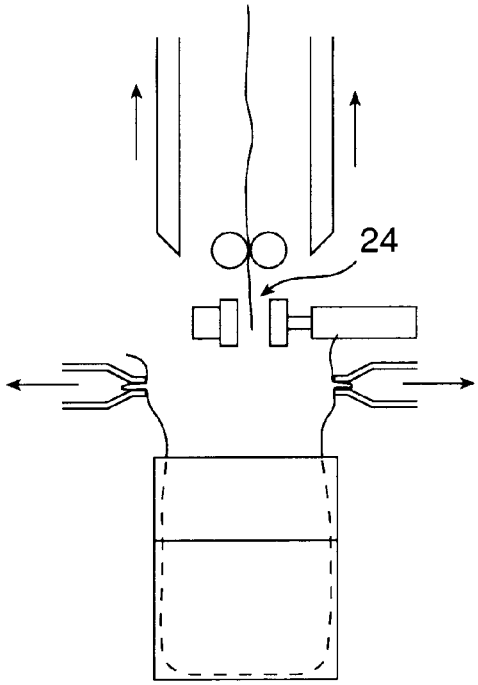
Figure 4F:
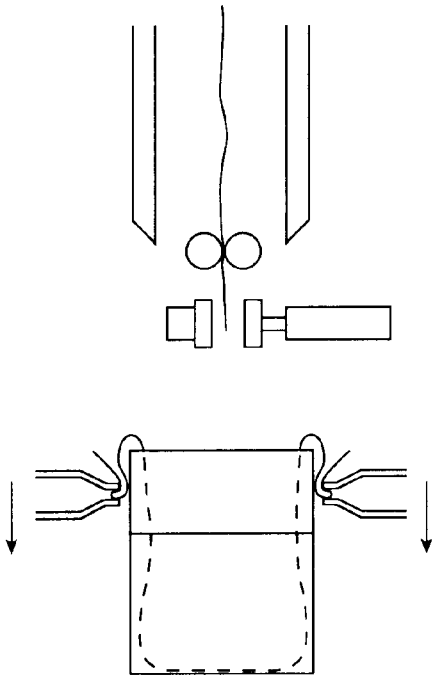
Figure 4G:
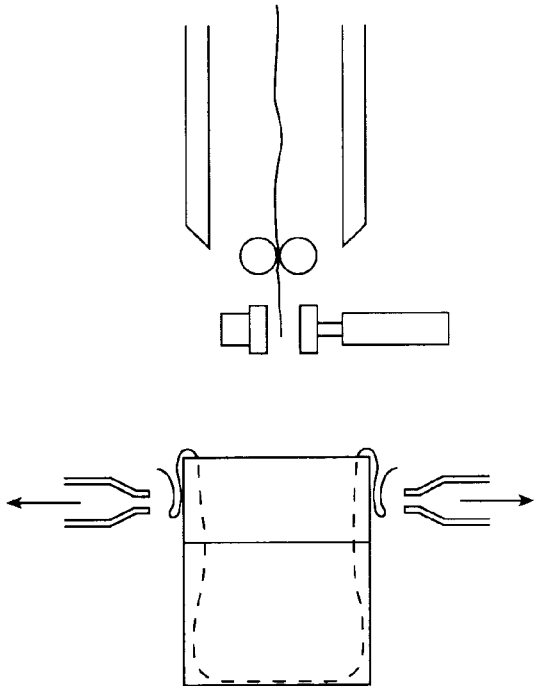
Figure 4H:
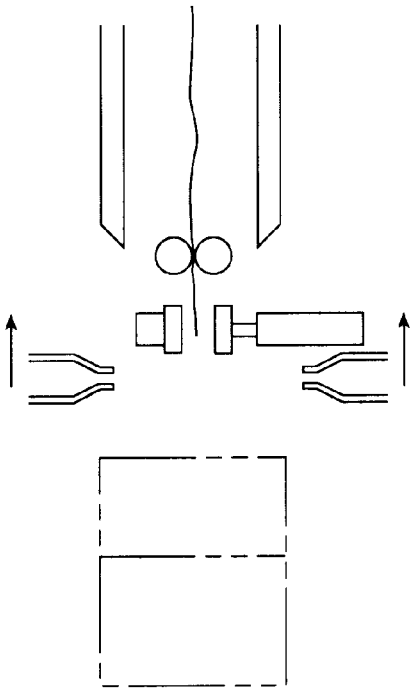

As shown in FIG. 4E, the vacuum tubes 18 can then be deactivated and then removed from the container 20, as the clamps cuff the liner section by pulling the end of the liner section down over the sides of the container 20 as shown in FIG. 4F. The clamps 8 then release the liner section (FIG. 4G) and return to their start position in FIG. 4*h*. The container is then transported to a different location while a new container is positioned to be lined and the process is repeated.

Figure 6:
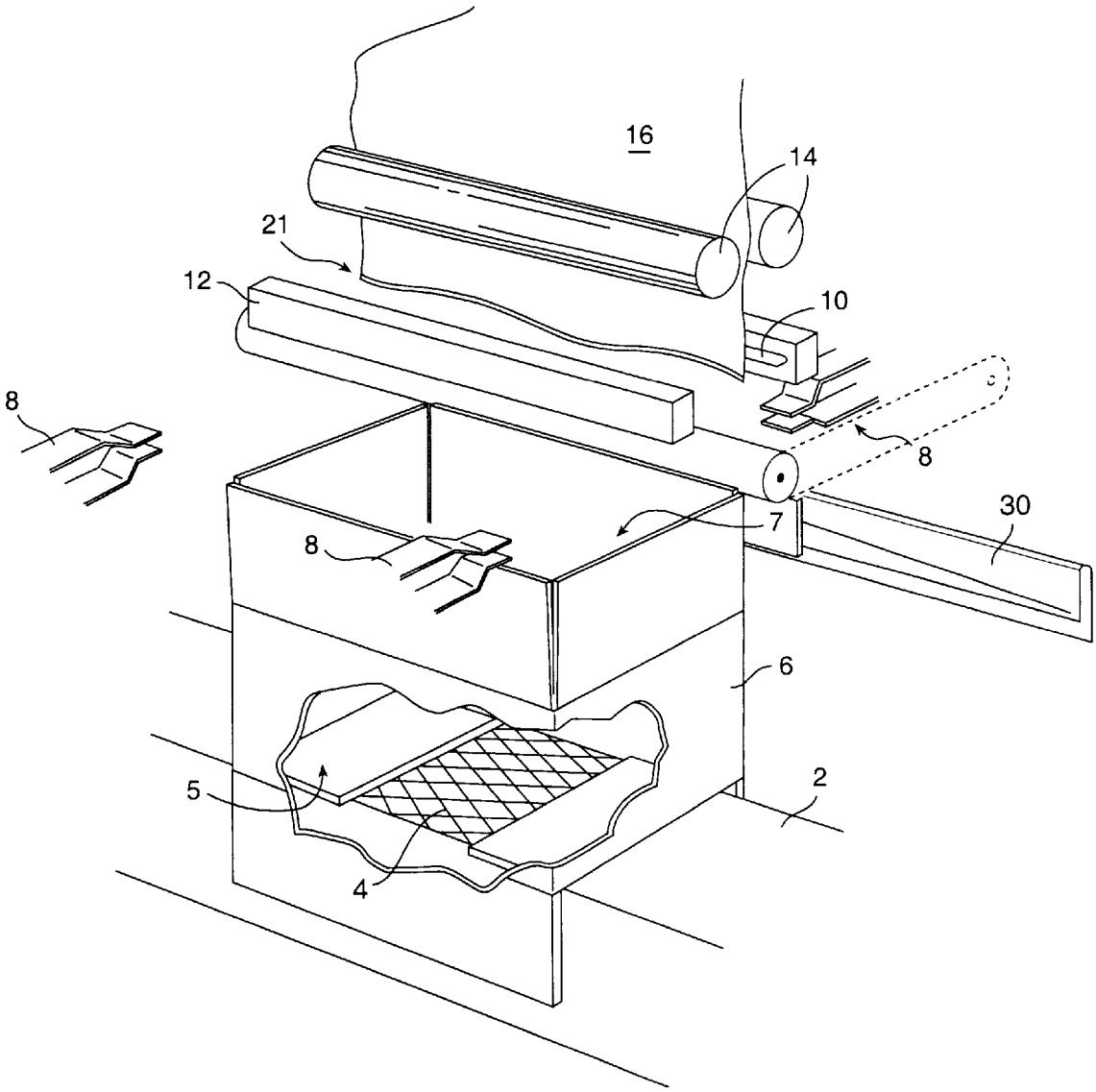
FIG. 6 provides a perspective view of the more preferred embodiment shown in FIGS. 5A through 5H.

A more preferred embodiment is shown in FIG. 6. As discussed above, the more preferred embodiment includes a conveyor 2 for supporting a container 6 such as a typical cardboard box. As with many cardboard boxes, the container 6 has a set of four flaps on the top and bottom for sealing the box. It should be noted that new cardboard boxes, such as those typically used in packaging products, these four flaps are relatively rigid, upstanding elements which typically do not move or interfere with the lining and cuffing steps discussed herein. The container is placed on the conveyor 2 with at least two of the bottom flaps open so that the inside of the container is exposed to the vent 4. The vent 4 is coupled to any conventional means for drawing air from the inside of the container (i.e. for creating a vacuum or near vacuum condition). For example, a vacuum plenum, or even a simple fan of sufficient drawing power, fan can be incorporated to draw air from the inside of the container 6.

Positioned to one side of the container 6 are two rollers 14 for feeding a flexible liner 16 (i.e. a plastic or latex liner), having a sealed end 21. Although illustrated here as employing two rollers, it should be apparent to one skilled in the art that any means for feeding a flexible liner can be used and this invention is not limited to a particular number of rollers or to rollers at all.

A clamp cylinder 12 and a knife 10 are preferably located directly beneath the rollers 14 for cutting off a section of the liner and sealing the bottom edge of the next liner 24. The clamp cylinder 12 and knife 10 are designed in such a manner that a sealing means is located above a cutting means. This allows the clamp cylinder 12 and knife 10 combination remove a section of the liner wherein the liner section has an unsealed top 22, while the remaining liner is sealed at its bottom. By sealing the bottom of the remaining liner, the present invention ensures that upon the next cycle, the next liner section will have a sealed bottom edge 24. Any conventional and well known sealing means can be used such as those used to seal plastic food bags (i.e. a heated metal or composite strip). The cutting edge can be any edge sharp enough to cut through the liner. Alternatively, a roll of pre-sealed liners with perforations for separating one liner from the next can be used with the present invention.

Below the clamp cylinder 12 and knife 10 are clamps 8 for engaging the liner section and spreading open the unsealed end 22 of the liner section. Although the clamps 8 can be of any design for gripping the sides of a liner and separating them, an example of a suitable design is illustrated in U.S. Pat. No. 4,874,354 to Johnson el al., hereby incorporated by reference. Furthermore, it is contemplated in the preferred embodiment that four clamps 8 be incorporated which can be positioned during the lining process roughly above the four corners of the container 6. This does not preclude, however, the application of more or less clamps or different positions of the clamps 8.

Below the clamps 8 is mounted a liner tray 30 and a pivoting liner guide roller 32, the function of which will be discussed below.

Figure 5A:
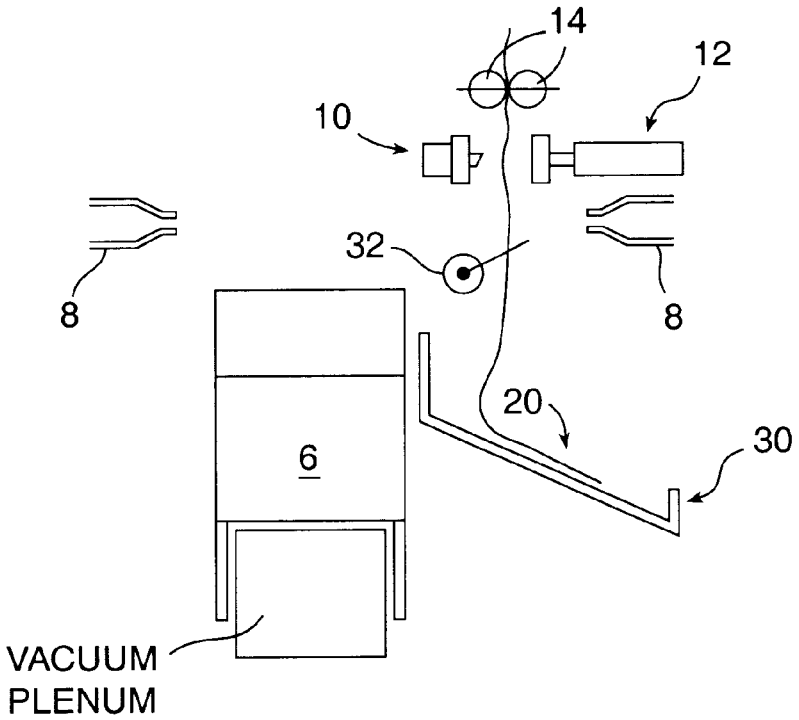
FIGS. 5A through 5H illustrate a more preferred sequence of steps performed by a more preferred embodiment.
Figure 5B:
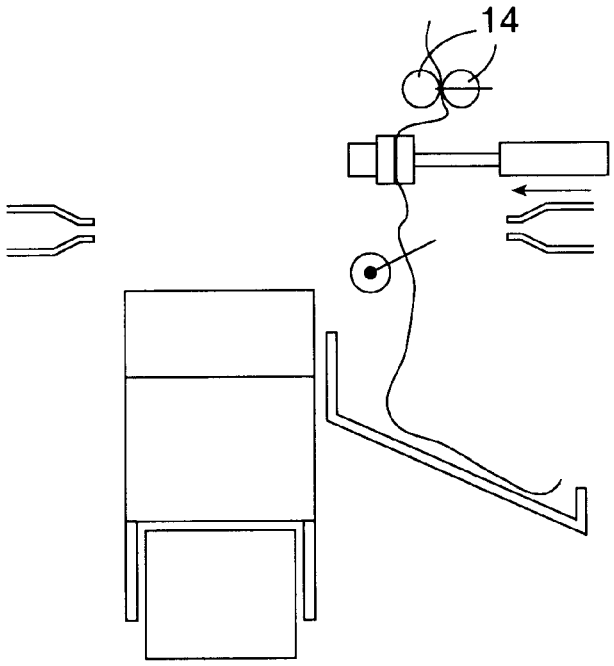
Figure 5C:
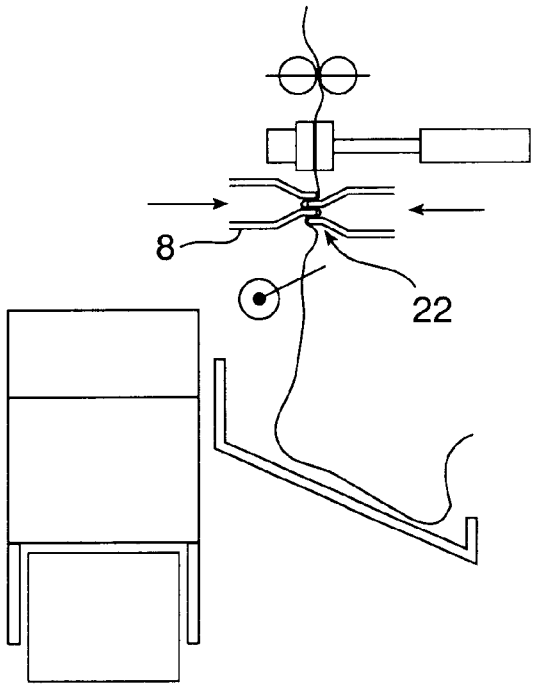

FIGS. 5A through 5H illustrate the operation of this more preferred embodiment. In FIG. 5A, the conveyer 2 has positioned a new container 6 over the vacuum plenum, while the two rollers 14 feed a length of liner 16 (sealed end 21 first) past guide roller 32 and onto the tray 30 positioned beneath the rollers 14 to one side of the vacuum plenum. When the appropriate length has been fed, the clamp cylinder 12 and knife 10 engage the liner 16 thereby cutting a section of the liner 16 and sealing the bottom edge 24 of the next liner in FIG. 5B. While the clamp cylinder 12 and knife 10 are still engaged, the clamps 8 grip the liner section below the clamp cylinder 12 and knife 10 in FIG. 5C. It should be noted that while shown here in this order, the present invention should work equally well if the clamps 8 grip the liner before the clamp cylinder 12 and knife 10 engage. It should also be noted that while a minimum of two clamps 8 are necessary for proper operation, additional clamps may also be incorporated.

Figure 5D:
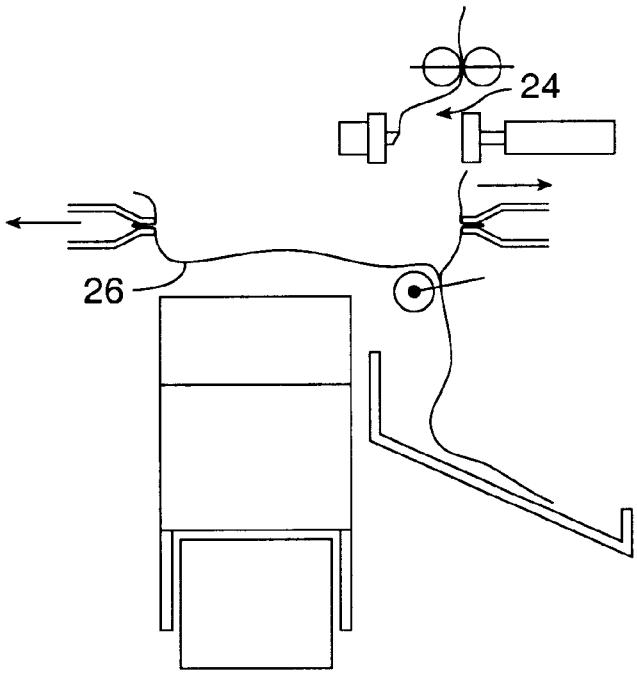

In FIG. 5D, the clamps 8 open the liner section by relative movement away from each other to separate the sides of the liner section, and to pull one side of the liner section, denoted as 26, over the open end of container 6, while the clamp cylinder and knife 10 separate to prepare for forming the next liner.

Figure 5E:
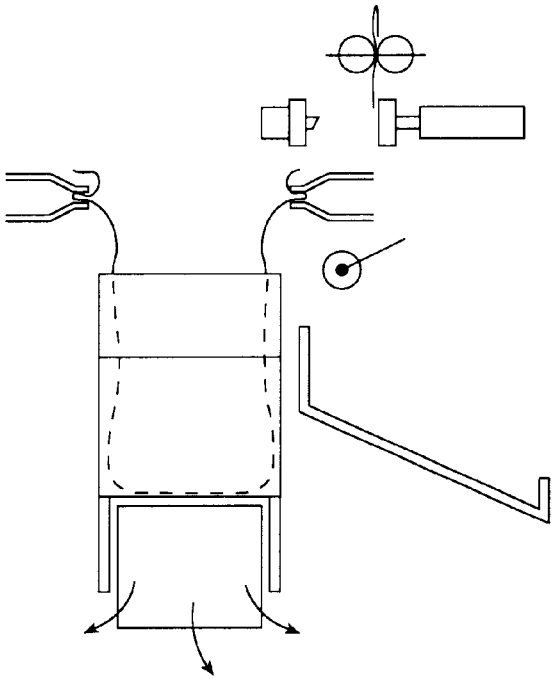

As shown in FIG. 5E, the vacuum plenum is then activated to create a vacuum or near vacuum condition in the container, which rapidly draws sealed end of the liner into the container 6, and fully opens the bag in the container. All that remains outside of the container 6 is the open end of the bag which remains secured by the clamps 8.

Figure 5F:
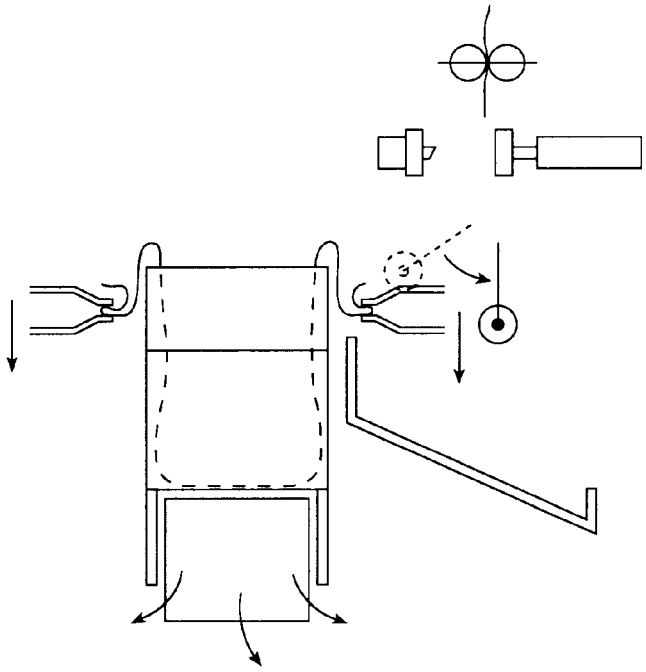

As the clamps 8 move downward to cuff the open end of the liner over the upstanding flaps of the container 6, as shown in FIG. 5F, the guide roller 32 pivots away to avoid interfering with the cuffing process. The vacuum plenum remains activated during cuffing. Once clamps 8 have reached the bottom of their downward stroke, the vacuum plenum is disengaged.

Figure 5G:
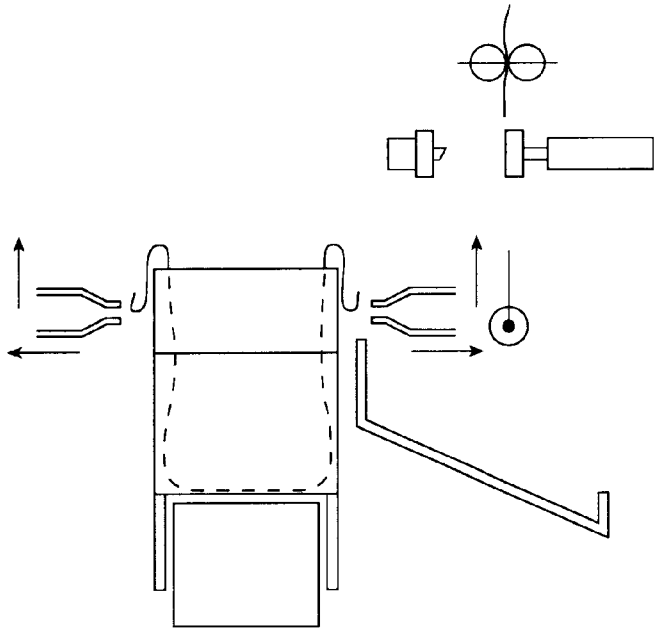

As shown in FIG. 5G, the clamps open and return to their starting position, while the guide roller 32 pivots back to its starting position. Then, the conveyor moves the lined container 6 away to be filled with product.

Figure 5H:
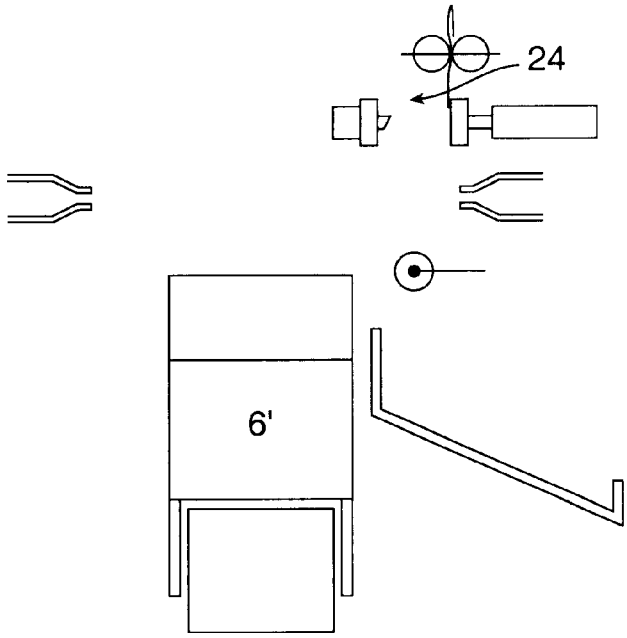

FIG. 5H shows a new container 6' positioned over the vacuum plenum, and the components of the container liner in their starting position ready to begin again the process of lining container 6'.

In should be noted that in all embodiments, a liner section that has previously been cut to size, can be utilized. This would eliminate the need for the clamp cylinder 12 and knife 10. Furthermore, it should be noted that the liner is not limited to plastic or latex, but may be composed of any material flexible enough to be expanded by a vacuum or near vacuum condition.

From the above, it is clear that the present invention provides a quick and reliable method and apparatus for lining a container having one or two openings. Advantageously, the apparatus allow for the lining of a container without having to invert the liner during the lining process. The invention has been described in terms of the preferred embodiment. One skilled in the art will recognize that it would be possible to construct the elements of the present invention from a variety of materials and to modify the placement of the components in a variety of ways. While the preferred embodiments have been described in detail and shown in the accompanying drawings, it will be evident that various further modifications are possible without departing from the scope of the invention as set forth in the following claims.

We claim:

1. A method for lining containers with a flexible bag-type liner comprising the steps of:

a. providing an unopened flexible bag-type liner having a sealed end and an unsealed end, and at least one wall, a container having an interior surface, at least a first open end, a means for drawing air from said container, a means for suspending said liner above said open end of said container, at least one pair of clamps, said pair of clamps mounted so that a first clamp of the pair is mounted on one side of liner and a second clamp of the pair is mounted on an opposite side of said liner, with said first clamp mounted for relative movement towards and away from said second clamp of the pair and for interaction with said second clamp for opening the unsealed end of said liner;

b. suspending said sealed end of the unopened liner below said first open end of said container, and said unsealed end of the unopened liner above said sealed end of the liner and outside of the container;

c. grabbing the unsealed end of the liner with the clamps;

d. moving at least one of the clamps away to open the unsealed end of the liner; and e. actuating the means for drawing air from the container to draw the wall of the liner against the interior surface of the container thereby substantially fully opening the liner in the container.

2. The method of claim 1, further comprising the step of cuffing the unsealed end of the liner over the open end of the container after the liner has been substantially fully opened in said container.

3. The method of claim 1, wherein the means for drawing air comprises a vacuum plenum over which the container is positioned during lining.

4. The method of claim 1 wherein during the step of suspending the unsealed end of the unopened liner above said sealed end, the sealed end of said liner is disposed outside of and adjacent to said container below said first open end of said container.

5. The method of claim 4 wherein during the step of moving at least one of the clamps away to open the unsealed end of the liner, the wall of the liner is drawn over the open end of said container.

6. A method for lining containers with a flexible bag-type liner, using an apparatus having a conveying means, a container having a wall and at least one open end, said container positioned on said conveying means, a vacuum means mounted at a lining station along said conveyor, a continuous source of flexible liner material of generally tubular shape for forming liners having a wall, a-leading sealed end, and an open trailing end, said continuous source of flexible liner material mounted above said lining station; a means for feeding said flexible liner material along a predefined path; a cutting and sealing means mounted above said lining station and along said predefined path; at least one pair of clamps mounted above said lining station and below said cutting and sealing means for opening said open trailing end of the formed liners, a first clamp of said pair of clamps mounted on one side of said predefined path and a second clamp of the pair is mounted opposite said first clamp on an opposite side of said predefined path; with at least said first clamp mounted for relative movement towards and away from said second clamp; the method comprising the steps of:

a. feeding the leading sealed end of the unopened liner material along the predefined path whereby said sealed end is suspended between the open end of the container and the conveying means;

b. engaging the liner material with the cutting and sealing means a predetermined distance from the sealed end, to form a liner having an unsealed trailing end;

c. moving the first clamp relatively towards the second clamp until the wall of the liner at the unsealed trailing end has been secured by the clamps;

d. moving the first clamp relatively away from the second clamp to draw the wall of the liner over the open end of the container to open the trailing unsealed end of the liner; and e. actuating the vacuum means for drawing air out of the container to draw the wall of the liner against the wall of the container, thereby substantially fully opening the liner in the container using vacuum alone.

7. The method of claim 6, further comprising the step of cuffing the unsealed end of the liner over the open end of the container after the liner has been substantially fully opened in the container.

8. The method of claim 6, wherein the vacuum means comprises a vacuum plenum mounted at the lining station and over which the container is positioned during lining.

9. The method of claim 6 wherein the predefined path is outside and adjacent to the container.

10. An apparatus for lining containers having one or more walls, an interior surface, a bottom and at least a first open end, comprising:

a. a means for feeding a leading sealed end of an unopened flexible bag-type liner having a wall, a sealed end and an unsealed end, along a predefined liner path, said predefined path extending from a first position at said means for feeding generally downwardly to a second position vertically below said open end of said container where said sealed end is suspended prior to opening; and wherein said predefined liner path includes a tray mounted outside and adjacent to said container, said tray providing a surface onto which the sealed end of the unopened liner can be fed by the means for feeding;

b. a means for engaging and separating the walls at the unsealed end of the liner after the sealed leading end of the unopened liner has reached said second position; and c. a vacuum means for drawing the wall of the liner against the interior surface of the container for substantially fully opening the liner in the container.

11. The apparatus of claim 10, wherein the vacuum means comprises a vacuum plenum over which the bottom of the container is positioned during lining.

12. The apparatus of claim 11 additionally comprising a conveying means for automatically moving a container to be lined over said vacuum plenum.

13. The apparatus of claim 10 additionally including a means for cutting and sealing mounted along said predefined liner path above said open end of said container, and wherein said liner is formed from a continuous length of flexible liner material having a sealed leading edge.

14. The apparatus of claim 10 wherein said means for engaging and separating includes at least a first liner engagement assembly mounted on one side of said predefined liner path and a second liner engagement assembly mounted opposite said first assembly on an opposite side of said predefined liner path, whereby said unopened liner passes between said first liner engagement assembly and said second liner engagement assembly as it moves along said predefined liner path; with at least said first liner engagement assembly mounted for relative movement along a predefined assembly path towards and away from said predefined liner path, said predefined assembly path extending above and across the open end of said container, each said liner engagement assembly including one or more from the group consisting of mechanical clamps, vacuum cups, and vacuum bars.

15. The apparatus of claim 14 wherein said liner engagement assembly path includes both horizontal and vertical movement.

16. The apparatus of claim 10 wherein said means for engaging and separating includes two pairs of clamps, a first clamp of each pair of clamps mounted on one side of said predefined liner path and a second clamp of each pair mounted opposite said first clamp on an opposite side of said predefined liner path; with at least said first clamp mounted for relative movement along a predefined clamp path towards and away from said predefined liner path, said predefined clamp path extending above and across the open end of said container, a first pair of said two pairs of clamps being positioned to engage a first outside edge of said liner, and a second pair of said two pairs of clamps being positioned to engage a second outside edge of said liner.

17. An apparatus for lining containers having one or more walls, an interior surface, a bottom and at least a first open end, comprising:

a. a means for feeding a leading sealed end of an unopened flexible bag-type liner having a wall, a sealed end and an unsealed end, along a predefined liner path, said predefined path extending from a first position at said means for feeding generally downwardly to a second position vertically below said open end of said container where said sealed end is suspended prior to opening;

b. a clamping means for grabbing the unsealed end of the liner and separating the walls at the unsealed end of the liner after the sealed leading end of the liner has reached said second position; and c. a vacuum means for drawing the wall of the liner against the interior surface of the container for substantially fully opening the liner in the container;

said predefined liner path including a tray mounted outside and adjacent to said container, said tray providing a surface onto which the sealed end of the liner can be fed by the means for feeding.

18. An apparatus for lining containers having one or more walls, an interior surface, a bottom and at least a first open end with a liner having a sealed end, an unsealed end, and opposing liner walls, comprising:

a. a means for feeding a leading sealed end of an unopened flexible bag-type liner downwardly along a predefined liner path, said predefined path extending from a first position at said means for feeding generally downwardly to a second position vertically below said open end of said container and said unsealed end of said liner where said sealed end is suspended prior to opening;

b. a means for engaging and separating the opposing liner walls at the unsealed end of the liner after the sealed leading end of the unopened liner has reached said second position, thereby at least partially blocking the open end of the container with the liner; and c. a vacuum means for sucking the liner against the interior surface of the container for substantially fully opening the liner in the container, said vacuum means including a switch for activating the vacuum when the clamping means has separated opposing walls of the unopened liner at the unsealed end and at least partially blocked the open end of the container with the liner.

19. The apparatus of claim 18 wherein said means for engaging and separating is one or more selected from the group consisting of mechanical clamps, vacuum cups, and vacuum bar assemblies.

* * * * *